US005134755A

United States Patent [19]

Jornot et al.

[11] Patent Number: 5,134,755

[45] Date of Patent: Aug. 4, 1992

[54] METHOD AND APPARATUS FOR CONTROLLING A DRAFTING UNIT

[75] Inventors: Erich Jornot, Seuzach; Michael Leu, Winterthur, both of Switzerland

[73] Assignee: Maschinenfabrik Rieter AG, Winterthur, Switzerland

[21] Appl. No.: 817,988

[22] Filed: Jan. 9, 1992

Related U.S. Application Data

[63] Continuation of Ser. No. 566,627, Aug. 13, 1990, abandoned.

[30] Foreign Application Priority Data

Aug. 11, 1989 [CH] Switzerland ..... 02955/89

[51] Int. Cl.[5] ..... G01D 3/04; D01H 5/32

[52] U.S. Cl. ..... 19/239; 364/470

[58] Field of Search ..... 19/239, 240; 364/470

[56] References Cited

U.S. PATENT DOCUMENTS 4,494,204 1/1985 Hösel ..... 364/470
4,653,153 5/1987 Felix et al. .
4,791,706 12/1988 Weining et al. .
4,812,993 3/1989 Konig et al. ..... 364/470
4,974,296 12/1990 Vidler ..... 19/239

FOREIGN PATENT DOCUMENTS 58-031124 2/1983 Japan .
0824070 11/1959 United Kingdom .
2061338 5/1981 United Kingdom ..... 19/239
2081758 2/1982 United Kingdom ..... 19/239

*Primary Examiner*—Werner H. Schroeder
*Assistant Examiner*—John J. Calvert
*Attorney, Agent, or Firm*—Sandler, Greenblum, & Bernstein

[57] ABSTRACT

A method and apparatus for controlling a drafting unit for textile slivers. The driving apparatus for the drafting unit is controlled by a main control and at least one auxiliary control. The drafting unit includes an upstream measuring element and a downstream measuring element which deliver measured signals to a central computer unit. A signal representing the inlet sliver cross-section is determined by means of an identification field parameter and by using the downstream measured signal. The identification field parameter is continuously adjusted during operation. A threshold switch is used to control the compensation for irregularities in the incoming sliver.

41 Claims, 3 Drawing Sheets

1
1.1
1.2
2
2.1
2.2
2.3
3
3.1
3.2
4
4.1
4.2
4.3
5
5.1
5.2
6
6.1
6.2
7.1
7.2
7.3
8.1
8.2
8a
8b
8c
8d
8e
9.1
9.2
9a
9b
10
10a
10b
11
12
13
15.1-15.6
16
17
18
v1
v2
v3
v4
v5
v6
T
$v_{in}$
$v_{out}$
$v_1 = v_2 < v_3 = v_4 < v_5 = v_6$ PATH 1
PATH 2
PATH 3
PATH 4
OUTLET MEASURING UNIT
INLET MEASURING UNIT
NOMINAL MAIN DRAFT
PRELIMINARY DRAFT
MINIMILIZATION OF ΔB
MINIMILIZATION OF ΔH
CALCULATION OF: me = f(Cx, Rx)
IDENTI-FICATION FIELD ℜ
OFF/ON
Vout
Vin
Aset
Aout
mA
mE
ma
me
Cx
Rx
HV(1+Δm+Δh)
1+Δm+Δh
Δh
Δm
dA
ΔB
ΔH
fB
St1
me(t1)
Rx(t1,T2)
Cx(t1,T2)
me = f(Cx,Rx)
δ
p1
p2
x/y
t1
T2
Z1.1
Z1.2
Z2.1
Z2.2
Z3
Z4
K1
K3
9.1
9.2
10
11
12
19
25
35
36
37
38
39
40
42
43
44
46
47
48
49
50

METHOD AND APPARATUS FOR CONTROLLING A DRAFTING UNIT

This application is a continuation of application Ser. No. 07/566,627, filed Aug. 13, 1990, now abandoned.

BACKGROUND OF THE INVENTION

1. Field of the Invention

The present invention relates to a method and apparatus for controlling a drafting unit for use in the textile industry.

2. Description of Background and Other Information

Various known devices and control systems for equalizing textile slivers are based on the draft thereof. Usually the slivers are doubled and equalized in a two-stage drafting process, i.e., a preliminary draft and a main draft. The object of the drafting process is to produce a substantially uniform sliver. The drafting unit is supplied with irregular or non-uniform slivers, which are to be combined at the outlet into a sliver having a substantially uniform predetermined cross-section. It is necessary, therefore, to control the drafting process. There are various prior-art drive means and automatic control devices for addressing this problem.

For example, open and closed control loops and combinations thereof are known for measuring the sliver cross-section on the outlet side or delivering measurable variables corresponding to the cross-sections at the inlet, so as to control the draft by the unit, via final control elements. The problems of using open control loops are known in automatic control engineering in general and in the control of drafting processes in particular. The difficulties result from the transit time between the measuring point and the final control element and also through lack of feedback information. Further, in drafting units there are additional problems specifically related to the drafting process.

On the other hand, closed control loops also present difficulties, e.g., because short-term disturbances cannot be compensated due to the dead time between the measurable variable and the final control element. There are also difficulties in measurement technology with regard to the processing of the sliver.

European Patent Application No. 0 176 661, for example, discloses a method and apparatus for optimizing the drafting process in controlled drafting units in the textile industry, including an open and a closed control loop. The specification, starting from the aforementioned difficulties, proposes providing a feedback path between the output-side measuring point and the control circuit, and using the feedback information to influence the control parameters. The control concept, which is basically known, comprises computerized coordination of the input and output measurable variables by means of cross-correlation.

In the prior art, account is taken of both an output-end and an input-end measurable variable, which can in principle result in improved control of the uniformity of a sliver. On the other hand, the known devices and methods do not take account of the special features of control engineering and particularly of measurement technology, so that these control systems, in spite of additional steps, give only limited results.

Another result of these special features in the control of drafting units is that the installations need to be monitored during operation and some parameters need to be manually adjusted or corrected. One particular disadvantage is that dead time and/or amplification usually are required to be set manually and adjusted during operations. This requires continuous monitoring by an operator.

Additional problems are caused by the prior art design of the drive means and devices. Disturbances and fluctuations caused by the drives are taken into account by the known control systems, but it has been found that if the corresponding disturbances are to be taken into account in a single main or overall control system, it is necessary to compensate very large control ranges, and this overloads conventional equipment.

Another disadvantage is that the entire computer load is concentrated and the timing of the control system is not optimized.

SUMMARY OF THE INVENTION

An object of the invention, therefore, is to devise a method and apparatus for control of a drafting unit which enables the method to be automated and the sliver equalization to be optimized after the control guide variables have been set.

According to the present invention, the drive system, the control, and the measuring system are adapted to one another in an optimum manner, thus optimizing the equalization. Also, the system can be controlled so that manual intervention is largely superfluous. This largely eliminates the hitherto-required adjustments and adaptations of parameters during operation, which had to be carried out by operators and were, therefore, an additional source of error.

To this end, the control according to the invention includes:

measuring a characteristic of the sliver, such as its cross-section, in particular, in an upstream zone and producing an upstream measurement output signal for the open control loop and the closed loop;

measuring the sliver characteristic in a downstream zone and producing a downstream measurement output signal for the open control loop and the closed loop; and adjusting a control parameter of at least one control unit as a function of at least the downstream measurement output control signal.

According to a further aspect of the invention, the adjustment of the control parameter of the at least one control unit includes adjusting an identification field of an identification field unit as a function of at least the downstream output measurement control signal.

More particularly, the invention includes:

inputting the upstream measurement output signal as input magnitude to the identification field unit and to a central computer;

inputting the downstream measurement output signal to the central computer;

converting the upstream measurement output signal into an upstream sliver cross-section signal as a function of the identification field, representing the upstream sliver cross-section and short-term irregularities of the sliver at the upstream zone;

creating a draft compensation signal by draft compensation of the upstream sliver cross-section signal and inputting the draft compensation signal to the central computer; and determining, in the central computer, the effective dependence of the upstream sliver cross-section upon the upstream measurement output signal, and adjusting the identification field in response to the effective dependence.

Further according to the invention, at least one additional input variable can be inputted to the central computer, which could be additionally used in adjusting the identification field. Such additional input variable could be a function of the air humidity, for example.

Still further according to the invention, the downstream measurement output signal is used for controlling short-term deviations of the sliver from a mean value by:

inputting the downstream measurement output signal to a first control unit having a function of minimalizing high-frequency components of the downstream measurement output signal for determining a first time delay subsequent to the step of measuring the sliver characteristic in an upstream zone;

inputting the downstream measurement output signal to a second control unit having a function of minimalizing average or medium components of the downstream measurement output signal for determining an amplification factor.

The high-frequency components for the first control unit are obtained, according to the invention, by using a high-pass filter in the 100–300 Hz range.

The medium frequency components for the second control unit are obtained, according to the invention, by using a band-pass filter in the 10–100 Hz range.

An additional object of the invention includes a method and apparatus for controlling a final control device of a sliver drafting unit including:

(a) creating an upstream sliver cross-sectional signal representing a cross-section of the sliver by use of the upstream measuring element;

(b) comparing the upstream sliver cross-sectional signal to a preset value;

(c)(1) transmitting the upstream sliver cross-sectional signal directly to the final control device in response to the upstream sliver cross-sectional signal being determined, in the step of comparing, to be greater than the preset value, or (c)(2) multiplying the upstream sliver cross-sectional signal by a control amplification factor to obtain a multiplied signal and transmitting the multiplied signal to the final control device in response to the upstream sliver cross-sectional signal being determined, in the step of comparing, to be less than the preset value;

(d) switching off optimization of the control amplification and optimization of delay time subsequent to the step of creating the upstream sliver cross-sectional signal, in response to the upstream sliver cross-sectional signal being determined, in the step of comparing, to be greater than the preset value, and switching on optimization of the control amplification and optimization of the delay time in response to the upstream sliver cross-sectional signal being determined, in the step of comparing, to be less than the preset value; and (e) adding the signal determined in step (c), representing short-term deviations of the sliver and a signal representing long-term deviations of the sliver for adjusting the value of a manipulated variable for controlling the final control device.

In a specific embodiment of the invention, the upstream measuring element is a measuring capacitor, the step of producing an upstream measurement output signal includes measuring a change in dielectric caused passage of the sliver by the measuring capacitor.

According to an additional aspect of the invention, the invention includes dividing the upstream sliver cross-sectional signal into a real part and an imaginary part and inputting the upstream sliver cross-sectional signal into an identification field control unit and to a central computer.

In a further aspect of the invention, the upstream measurement output signal and the draft-compensated signal are inputted in the central computer after being compensated for a time delay between measurement of the characteristic of the sliver in the upstream zone and the downstream zone.

According to a particular embodiment of the invention, the time delay is compensated for in the central computer.

Further according to the invention, the drafting unit includes at least one auxiliary-controlled drive assembly and a set value of the at least one auxiliary-controlled drive assembly is set as a function of the value of a variable manipulated by the method.

In a specific embodiment of the invention, the control system is utilized for a drafting unit forming part of a drawframe or a combing machine.

BRIEF DESCRIPTION OF THE DRAWINGS

The above and additional objects, characteristics, and advantages of the present invention will become apparent in the following detailed description of the method according to the invention and a preferred embodiment of the invention, with reference to the accompanying drawings which are presented as a non-limiting example, in which.

DETAILED DESCRIPTION OF THE PREFERRED EMBODIMENTS

Figure 1:
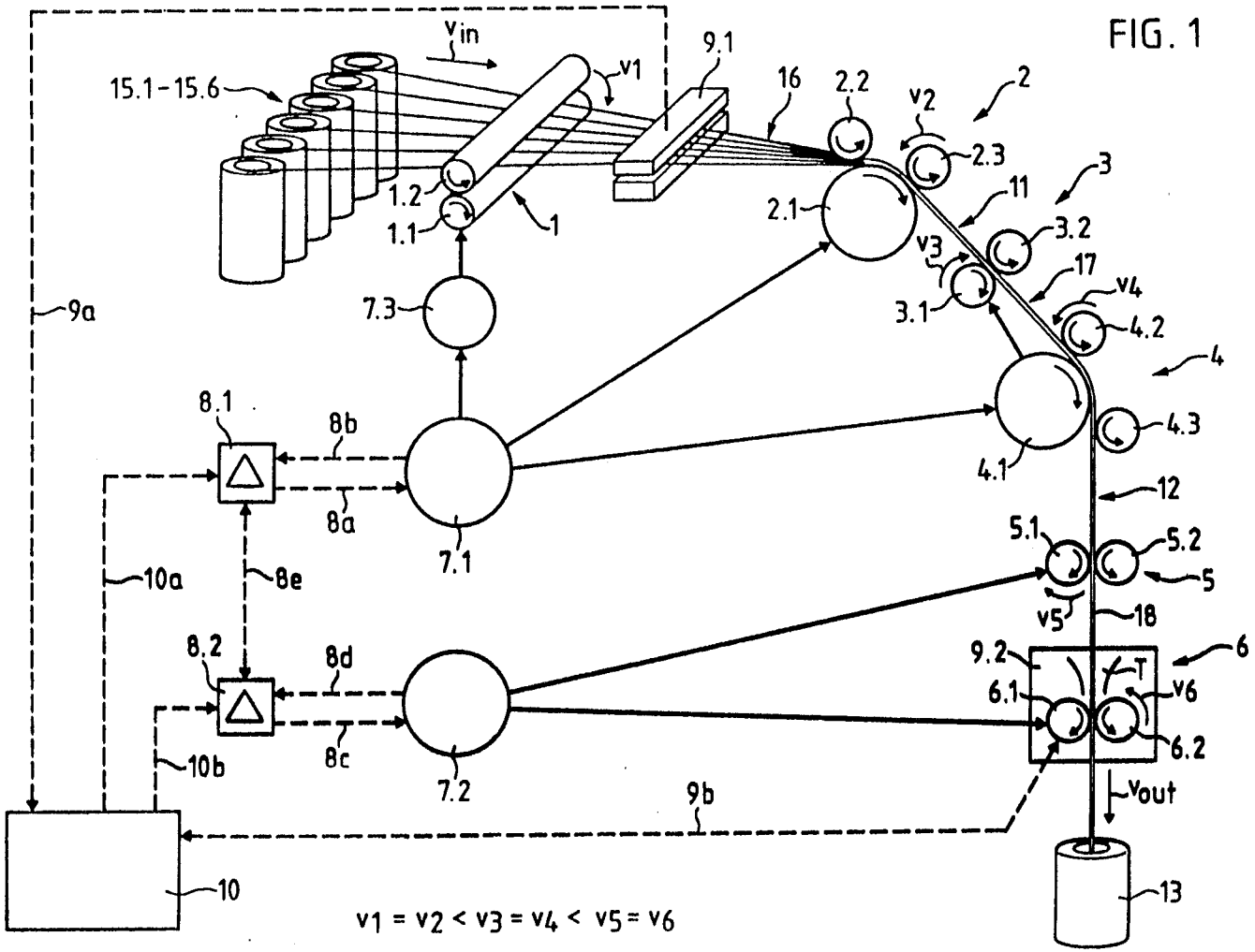
FIG. 1 shows a drafting unit comprising a preliminary drafting portion or zone, and a main drafting portion or zone , and the main measuring devices.

As shown in FIG. 1, which is a schematic diagram of the drafting unit according to the present invention, which also can be integrated in a combing machine, a number of slivers 15.1–15.6 (six in the example) are combined side-by-side into a loose fibrous web and are conveyed through a number of roller systems 1–6. The peripheral speeds of the rollers in the conveying direction of the fiber material increase in two stages, so that the material is pre-drafted (i.e., into a preliminary draft) in the first stage and is additionally drafted to the required cross-section (i.e., into a main draft) in the second stage. The fibrous web 18 leaving the drafting unit is thinner than the web of infed slivers 15.1–15.6 and is correspondingly longer. The drafting processes can be controlled in dependence on the cross-section of the infed slivers, so that the slivers or web are equalized in transit through the drafting unit, i.e., the cross-section of the emerging web 18 is more uniform than the cross-section of the infed web or slivers 15.1–15.6. The drafting unit comprises a preliminary drafting zone 11 and a main drafting zone 12. Of course, the invention can also be applied in a similar manner to units comprising only one drafting zone or more than two zones.

Slivers 15.1–15.6 are supplied to the drafting unit by two systems 1, 2 of conveying rollers. A first system 1 comprises, e.g., two rollers 1.1 and 1.2, between which the infed slivers 15.1–15.6 are conveyed, after being combined into a loose fibrous web. Further along the conveying direction of the slivers there is the roller system 2, which in the present case comprises an active conveying roller 2.1, i.e., a power-driven roller, and two passive conveying rollers 2.2 and 2.3. The slivers 15.1–15.6, on being fed side-by-side through the roller systems 1 and 2, are combined into a fibrous web 16. The peripheral speeds $v_1$ and $v_2$ ($=v_{in}$) of all the rollers in the two feed systems 1 and 2 are equal, so that the thickness of web 16 is substantially equal to the thickness of the infed slivers 15.1–15.6.

The two feed roller systems 1 and 2 are followed, in the conveying direction of web 16, by a third system 3 of pre-drafting rollers 3.1 and 3.2, between which the web is additionally conveyed. The peripheral speed $v_3$ of the pre-drafting rollers 3.1 and 3.2 is greater than the speed $v_1$ and $V_2$ of the inlet rollers or roller systems land 2, so that in the pre-drafting zone 11 the web 16 is drafted between the inlet rollers 2 and the pre-drafting rollers 3, thus reducing its cross-section and simultaneously producing a pre-drafted web 17 from the loose web 16 of infed slivers. The pre-drafting rollers 3 are followed by a system 4 comprising, e.g., an active conveying roller 4.1 and two passive conveying rollers 4.2 and 4.3 for additionally conveying the web, the peripheral speed $v_4$ of the conveying rollers 4 being the same as the speed $v_3$ of the pre-drafting rollers 3.

Roller system 4 is followed in the conveying direction of web 17 by a fifth system 5 of main drafting rollers 5.1 and 5.2. As before, the main drafting rollers have a higher surface speed $v_5$ than the preceding conveying rollers 4, so that the pre-drafted web 17 is additionally drafted in the main drafting zone 12 between the conveying rollers 4 and the main drafting rollers 5 and forms the finally drafted web 18, which is concentrated into a sliver through a funnel T.

The finally drafted sliver 18 is removed from the drafting unit between a roller pair 6 of outlet rollers 6.1, 6.2 having a peripheral speed $v_6$ ($=v_{out}$) equal to the speed of the upstream main drafting rollers ($v_5$), and deposited, e.g., in rotating containers or cans 13.

The roller systems 1, 2 and 4 are driven by a first motor 7.1 via a transmission, preferably via toothed belts. The pre-drafting rollers 3 are mechanically coupled to the roller system 4, and the transmission ratio can be adjusted relatively to roller systems 1 and 2 or a value can be preset. The transmission (not shown in detail in the drawing) determines the ratio between the peripheral speeds of the inlet rollers ($v_{in}$) and the peripheral speed $v_3$ of the pre-drafting rollers 3.1 and 3.2, i.e., the pre-drafting ratio. The inlet rollers 1.1 and 1.2 can likewise be driven by the first motor 7.1, or optionally via an independent motor 7.3.

The roller systems 5 and 6 are driven by a second motor 7.2. According to the invention, motors 7.1 and 7.2 each have a separate controller 8.1 and 8.2, respectively. The control is via a closed control loop 8*a*, 8*b* and 8*c*, 8*d*, respectively. In addition, the actual value of one motor can be communicated to the other motor in one or both directions via a control connection 8*e*, so that each can react accordingly to deviations of the other from the set value.

At the inlet of the drafting unit, the total cross-section of the infed slivers 15.1–15.6 is measured by an inlet measuring element 9.1. At the outlet of the drafting unit, the cross-section of the emerging sliver 18 is measured by an outlet measuring element 9.2.

A central computer unit 10 transmits an initial setting of the set value for the first drive 7.1 via 10*a* to the first controller 8.1. During the drafting process, the measurable values from the two measuring elements 9.1, 9.2 are continuously transmitted via connections 9*a* and 9*b* to the central computer unit. The measured results, and the set value for the cross-section of the emerging sliver 18 are used in the central computer unit 10, and in other components if required, to determine the set value for the second drive 7.2 by the method according to the invention. This set value is continuously set at the second controller 8.2 via 10*b*. By means of this control system, fluctuations in the cross-section of the infed slivers 15.1–15.6 can be compensated by appropriate control of the main drafting process and the sliver can be equalized.

The controllers in the auxiliary control system are position controllers (not speed controllers), since position controllers operate even when the motor stops. The corresponding controllers 8.1 and 8.2 (or any other controllers in variant embodiments) can contain separate computer units (or microprocessors in digital computer apparatus), or can be modules of the central computer unit 10.

The basic system of measurement will now be described in detail. The objective of the embodiment of the drafting unit shown is to produce a constant preliminary draft. The sliver cross-section is controlled and equalized substantially by varying the draft in the main drafting zone 12. The inlet measuring means or unit 9.1 delivers the input-side measuring signal containing information about the cross-section of the infed slivers 15.1–15.6. As is known, there are difficulties associated with measuring technology in obtaining the desired inlet measuring signal. It is difficult to measure the cross-section without adversely affecting the material and at a high dynamic level. Consequently, the measurement has to be indirect, using a transducer. Various conventional transducers are inadequate for the desired purpose.

Figure 2:
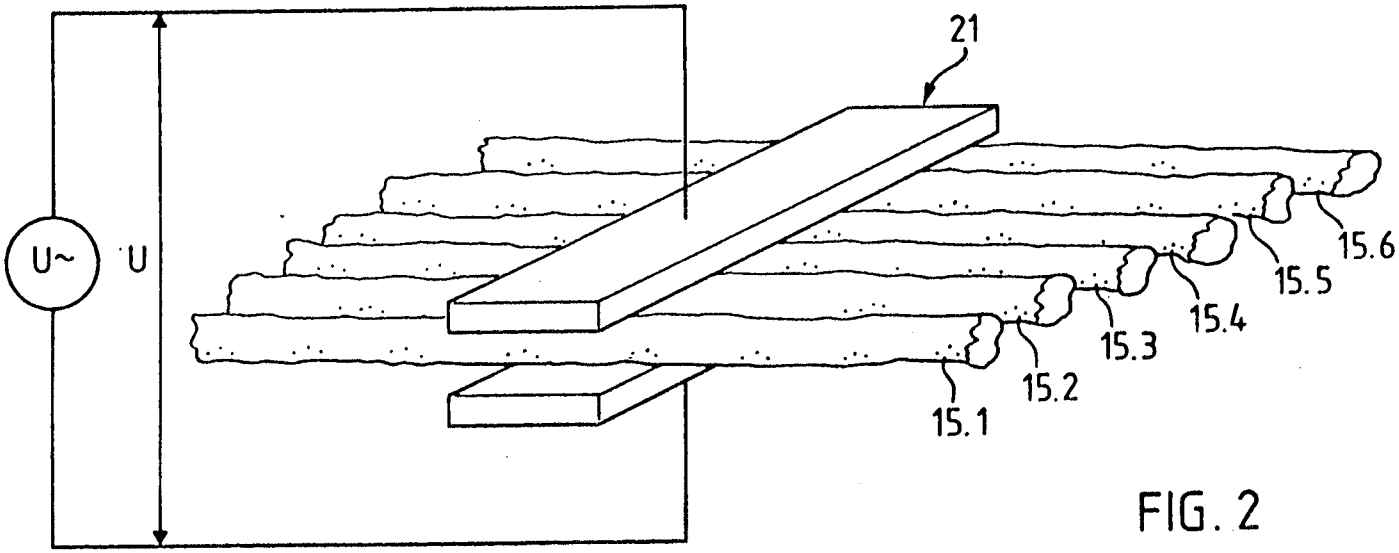
FIG. 2 shows a transducer for the inlet measuring means or unit.

In connection with the invention, therefore, use is made of a measuring capacitor 21 as shown in FIG. 2, through which the infed slivers 15.1–15.6 run. The principle utilized is that the dielectric is altered by fluctuations in the volume of the slivers running between the capacitor plates When the slivers run through capacitor 21, information about the dielectric can be obtained by applying an a.c. voltage U or by measuring the voltage U across the capacitor. However, the measurement may be considerably affected by the moisture content of the slivers and other factors, since the dielectric constant $\epsilon_w$ of water is 81, as compared with the dielectric constant $\epsilon_B$ of cotton, which is about 4. In other words, the difficulty is to obtain the desired signal directly via the transducer and by using the volume which is in the capacitor at a given time and which represents the total cross-section of the infed slivers. According to the invention, the voltage U is measured across the capacitor 21 and the resulting signal is divided into a real part $R_x$ and an imaginary part $C_x$. Signals $R_x$ and $C_x$ are evaluated in the control system, as explained hereinafter, and also taking account of the outlet measured signal. The difficulties in measurement on the inlet side are one reason for so constructing the control system according to the invention that errors in measurement are compensated by adaptive control.

The outlet measuring means or unit 9.2 can be a conventional measuring instrument which delivers a signal $A_{out}$ containing information about the cross-section of the emerging sliver 18. This signal also is subsequently additionally processed for control purposes. The required measurements need not be made directly at the inlet or outlet. It is only necessary to dispose one measuring means or unit in front, i.e., in an upstream zone, and one behind, i.e., in a downstream zone, with respect to the controlled system, i.e., the main drafting zone 12 in the present case. It would also be advantageous, e.g., to dispose the input-end measuring means or unit immediately in front (i.e., upstream) of the main drafting zone 12, to obtain advantageous dependence of the control system on time.

It is assumed that both high-frequency and low-frequency changes or non-uniformities in the sliver need to be corrected, to obtain an optimized control system. The control needs to keep the average value of the sliver substantially constant (the first priority) and also eliminate irregularities. The deviations of the controlled variable can be detected by the control system as high-frequency and low-frequency components of the measured variables for adjustment. The problem as regards measurement technology and automatic control engineering is to obtain information about these variables and convert it into the desired manipulated variable. In the case in particular of high-frequency changes, the transit time between the measuring element and the final control element must be allowed for. At the input end, i.e., in the case of the inlet measuring means or unit 9.1, it is possible to obtain the high-frequency signal components. Due to the dead time of the closed loop system, which is dependent on the output-end measurement by means of the outlet measuring means or unit 9.2, only the low-frequency components of the signal can be compensated in the control system here. Problems and errors due to measurement technology are now also taken into consideration according to the invention in the control system, by the fact that the measured signals from the outlet measuring means or unit 9.2 are taken into account for adapting the control system to errors or other deviations at the inlet end. An identification field ℝ, which is determined empirically and continuously adjusted during operation, is provided according to the invention for this purpose.

Figure 3:
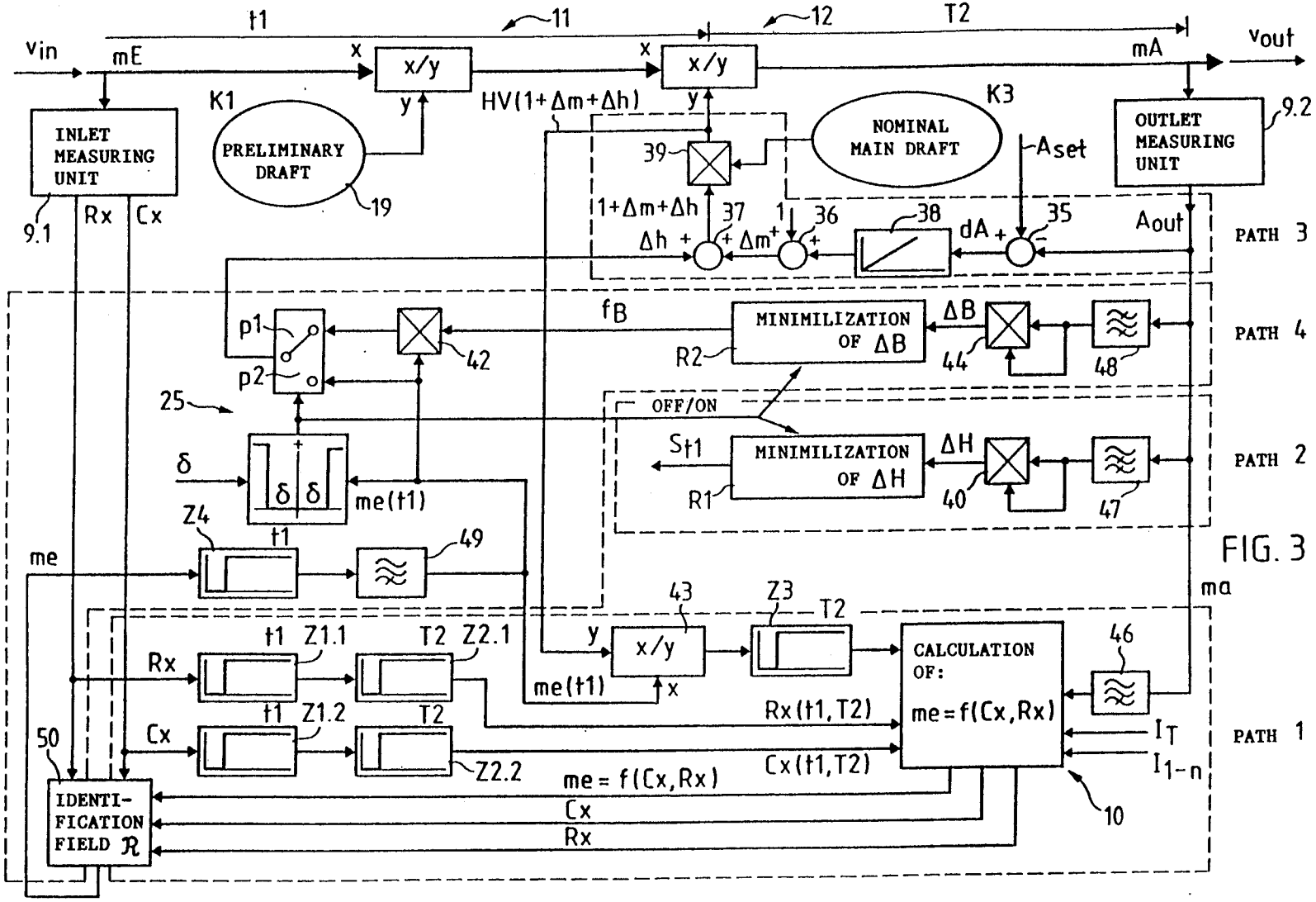
FIG. 3 shows the functional principle of the method according to the invention.

FIG. 3 illustrates the control principle and the method according to the invention, in a schematic diagram of the main control system. The drafting unit is indicated by arrows showing the direction of travel of the sliver, a block 11 for the preliminary draft and a block 12 for the main draft. The actual cross-section $m_E$ of the slivers at the inlet is represented by the variable $m_e$, and the actual cross-section $m_A$ of the already pre-drafted sliver is represented by the variable $m_a$, these two quantities in the present case being the measurements for a respective defined short sliver portion.

The slivers are fed at the inlet at a speed $v_{in}$ and the finished sliver emerges at the outlet at a speed $v_{out}$. The amount of preliminary drafting K1 can be adjusted by a presetting means 19. The control system is formed by the main drafting zone 12 in the present case. The transit time between the inlet measuring means or unit 9.1 and the main drafting zone 12 is denoted by t1, and the transit time between the main drafting zone 12 and the outlet measuring means or unit 9.2 is denoted by T2. The variables $A_{out}$, $R_x$, and $C_x$, measured by measuring means or units 9.1 and 9.2, are the input variables to a control system. The control system comprises a central computer unit 10 which is supplied with the variables $C_x$, $R_x$, the temperature $I_T$ and any additional information $I_{1-n}$, such as the air humidity. The variable $A_{out}$ is set as the guide variable.

For clarity, the control system is divided into a number of "Paths" 1–4, depicted by broken lines in the diagram of FIG. 3. A first Path 1 contains the central computer unit 10 with inlet and outlet leads and a number of time function elements Z1.1–Z3 and is used according to the invention for processing measured data. A second Path 2 is for optimizing the delay time t1. A third Path 3 is for optimizing the process of keeping the sliver value constant, and compensating long-term defects. Finally, a fourth Path 4 is provided for optimized compensation of short-term defects. The control system used in the invention is preferably digital, so that all of the components of the control system can be embodied in a computer In order to illustrate the control principle, the essential components necessary for understanding the invention are diagrammatically illustrated in FIG. 3.

Beginning at Path 3 (for keeping the mean value constant) a comparator 35 is provided and differentiates between the outlet signal $A_{out}$ and the set value $A_{set}$. The thus-determined deviation dA is fed through an I-element 38 to an adder 36. The deviations from the mean value are integrated in I-element 38, forming the signal ▲ m, and unity is added. The deviation is added in a second adder 37 to deviations ▲ h caused by short-term disturbances and determined in Path 1 and Path 4 as explained hereinafter, and finally the factor 1 + ▲ m + ▲ h is multiplied in a multiplier 39 by the preset nominal value K3 of the main draft. The corresponding multiplication gives the required manipulated variable y for controlling the main draft.

The outlet measured signal $A_{out}$ is also fed to a high-pass element 47 on Path 2. The filtered signal is squared by a multiplier 40 to obtain the signal ▲ H, which gives the high-frequency component of the fluctuations in the mean value. In this Path, account is taken of the high-frequency components, which in this embodiment are up to about 300 Hz. The signal ▲ H is fed to a first control unit R1 having a transmission function for minimalizing ▲ H. The control element R1 outputs the signal $S_{t1}$, which has an optimizing influence on the delay time of various time function elements Z1.1, Z1.2, Z4 or is directly fed to the central computer unit 10. In a preferred embodiment of the method, an additional corrective element (not shown here) is provided in Path 2 for determining the delay time t1. The additional element can be used under certain conditions at the input, e.g., if the sliver breaks, to correct the control system by a delay time t1 reduced by a certain short amount ▲ t1 at the final control element. By this means, if there are abrupt non-uniformities in the sliver at the inlet end, a complete correction is made, any over-compensation being acceptable.

According to the invention, the core member connecting Path 1 and Path 4 is an identification field element 50. Element 50 can, e.g., be a read-write memory and can be incorporated in the central computer unit 10. The identification-field element 50 stores an output identification field ℝ empirically determined with respect to the variables $R_x$ and $C_x$ and relates it to the variable $m_e = f(R_x, C_x)$. The identification-field element 50 is supplied with the measured pairs of values $R_x$, $C_x$ and delivers the variable $m_e$ as the output signal.

The identification field ℝ is continuously adjusted during operation, the adjustment being made in Path 1. In this embodiment, the signals $R_x$, $C_x$, after being delayed in corresponding time function elements Z1.1–Z2.2, are fed to the central computer unit 10. The time function elements Z1.1 -Z2 2 are adapted to take account of the entire transit time t1+T2 from the inlet to the outlet measuring means. The filtered variable $m_{e/(+1)}$, after being delayed to allow for the transit time t1 and after being draft-compensated in a divider 43, is supplied via a time function element Z3 to an additional input of the central computer unit.

The signal $A_{out}$, comprising information about the outlet sliver cross-section $m_A$ represented by the measured variable $m_a$, constitutes another input of the computer unit 10. The variable $m_a$ is preferably also filtered before being supplied to the central computer unit 10, the low-frequency signal components being clipped in a corresponding filter 46 on Path 1. Instead of using elements Z1.1–Z3, the transit time t1 can alternatively be taken directly into account by the central computer unit, by feeding thereto the output signal $S_{t1}$ on Path 2.

All of the signals delivered to the computer unit 10 are subsequently used for correcting the identification field ▮ of element 50, for which purpose the ("effective") variable $m_e$ relating to the respective pair of values $C_x$, $R_x$, and obtained by evaluating the measured data, constitute the output of the computer unit 10 and are transmitted to the identification-field element 50. As a result, the identification field ▮ is permanently adapted to changes within the control process. As can be seen, the central computer unit 10 must evaluate at least the signals $m_e$, $R_x$, $C_x$, $m_a$ in order to ensure that the identification field is adapted. Under certain conditions, however, the aforementioned additional measured data $I_T$, $I_{1-n}$ can be used for further improvement of the control.

In Path 4, as in Path 2, the signal $A_{out}$ is filtered, but this time via a band-pass element 48 instead of a high-pass element. The band-pass element 48 is followed by a multiplier 44 and a control unit R2 for minimalizing the corresponding signal ▲ B. The control unit R2 outputs a factor $f_B$ which is multiplied by the signal $M_{e/(t2)}$ in a multiplier 42. The signal $M_{e/(t1)}$ appears at the output of a filter 49, to which the signal $m_e$ from the identification field element 50 is supplied via a time function element Z4. Filter 49 clips the low-frequency components of the signal. Path 4 also contains a threshold-value switch 25 having an adjustable preset value δ. If the signal $m_{e/(t1)}$ is below the present value δ, the switch will be in a first position pl. As soon as the preset value δ is exceeded, i.e., $m_e$ fluctuates widely around the mean value, the switch changes to a position p2 at which the signal $m_{e/(t2)}$ travels directly to Path 3, so that these fluctuations are fully taken into account for the main draft. If, however, the values for $m_{e/(t2)}$ are below the preset value δ, Path 4 is used for optimization. The signal $m_{e/(t1)}$ is multiplied in multiplier 42 by the factor fs determined by means of the minimalization function of the control unit R2, and the output signal from the multiplier 42 is supplied to Path 3 via the threshold value switch 25. The threshold-value switch 25 switches over and the optimization is taken into account by the control unit R2, to prevent any disturbances caused, e.g., by noise from being let into Path 3 during small or very small temporary deviations from the mean value.

The threshold-value switch 25 is also used for switching on or off the optimization by the control units R1 and R2. Optimization by control units R1, R2 is switched off if $m_e$ is above the preset value δ, and switched on otherwise. It is not absolutely necessary to switch off the optimization by control units R1, R2 if the preset value δ is exceeded; an alternative in the corresponding control can also be achieved by compensation elements In a digital control system, however, switching the corresponding controls on and off is very simple, so that this variant is preferred.

The threshold-value switch can also be embodied by a non-linear device or can be incorporated in the identification field ▮. In the latter case the identification-field element 50 delivers both the output variable $m_e$ and also the required signal for activating or deactivating the optimization by control units R1, R2, or delivers a parameter dependent on amplitude.

In the present embodiment, the high-pass element in Path 2 can filter, e.g., frequencies above 100 Hz, whereas the band pass can filter frequencies in the range from 10 to 100 Hz. The frequency ranges depend on the transit speeds of the slivers, which in the present case are assumed to be in the range of about 600 meters per minute.

Note that the transmission functions of the control units R1, R2 can vary with the construction of the control system. In a preferred embodiment of the invention, the filters in Paths 2 and 4 can be omitted and the transmission functions can be determined in a manner which takes the frequencies in question into account in the required manner. Alternatively, the filter 46 in Path 1 can be omitted and filtering can be carried out by the central computer unit 10. Another advantage of being able to alter the parameters of the corresponding transmission functions is ease of adaptation to different operating conditions (e.g., variations in the throughput speed of the slivers).

In this connection, a specific embodiment comprises adaptive adjustment of the control parameters. The parameters of the transmission functions of control units R1, R2 are altered during the control, so that the variations of the manipulated variable are minimized. In this embodiment, the parameters of the transmission functions are determined by the central computer unit 10, using the measured quantities. In adaptive control, great stress must be laid on stability.

The central computer unit 10 is preferably a digital computing apparatus. Of course, the functions of the various Paths 1–4 explicitly shown in FIG. 3 for explaining the principle of operation can be partly or completely integrated in a single computer.

For example, the output identification field ▮ for $m_e$ can be obtained by static measurements at the measuring capacitor 21 and then stored in tabular form. Note that other identification fields have to be determined if the method of measurement is varied Accordingly, the inventive principle can be applied to other inlet and outlet measured signals, using corresponding identification fields.

The control principle according to the invention ensures excellent equalization even if there are unforeseen changes in operating conditions. More particularly, measuring errors on the inlet side are also compensated by the control. Short-term defects and also slow changes can both be compensated in optimum manner by the control. If the aforementioned method is used for the main control of the drafting unit in conjunction with auxiliary control of the independent drive groups and a corresponding interlinked control is provided, the conditions are particularly advantageous. Accordingly, the manipulated variable y determined by the main control is used as a set value for the controller 8.2 of the drive for the main drafting zone 12.

The methods and control according to the invention are suitable for all devices in the textile industry which require control of a drafting unit, and are not limited to the drafting unit mentioned in the description.

Finally, although the invention has been described with reference of particular means, materials and embodiments, it is to be understood that the invention is not limited to the particulars disclosed and extends to all equivalents within the scope of the claims.

What is claimed is:

1. A method of controlling a drive assembly of a drafting unit by means of at least one open control loop and at least one closed loop, including the measurement of at least one characteristic of a sliver being moved in an upstream-to-downstream direction through the drafting unit, said method comprising the steps of:

measuring said sliver characteristic in an upstream zone and producing an upstream measurement output signal for said open control loop and said closed control loop;

measuring said sliver characteristic in a downstream zone and producing a downstream measurement output signal for said open control loop and said closed control loop;

adjusting a control parameter of at least one control unit as a function of at least said downstream measurement output control signal; and said step of adjusting the control parameter of the at least one control unit comprises adjusting an identification field of an identification field unit as a function of at least said downstream output measurement control signal.

2. The method according to claim 1, further comprising the steps of:

(a) inputting said upstream measurement output signal as an input magnitude to the identification field unit and to a central computer;

(b) inputting said downstream measurement output signal to said central computer;

(c) converting said upstream measurement output signal into an upstream sliver cross-section signal as a function of said identification field and representing short-term irregularities of the sliver at said upstream zone;

(d) creating a draft compensation signal by draft compensation of said upstream sliver cross-section signal and inputting said draft compensation signal to said central computer; and (e) determining, in said central computer, the effective dependence of said upstream sliver cross-section signal upon said upstream measurement output signal as a function of said upstream sliver cross-section signal, said downstream measurement output signal, and said upstream measurement output signal, and adjusting said identification field in response to said effective dependence.

3. The method according to claim 2, further comprising inputting at least one additional input variable to said central computer and wherein said step of adjusting said identification field is additionally a function of said at least one additional input variable.

4. The method according to claim 1, wherein said downstream measurement output signal is used for controlling short-term deviations of said sliver from a mean value by means of the following steps:

(a) inputting said downstream measurement output signal to a first control unit having a function of minimalizing high-frequency components of said downstream measurement output signal for determining a first time delay subsequent to said step of measuring said sliver characteristic in an upstream zone;

(b) inputting said downstream measurement output signal to a second control unit having a function of minimalizing medium frequency components of said downstream measurement output signal for determining an amplification factor.

5. The method according to claim 4, further comprising using a high-pass filter in the 100–300 Hz range for obtaining said high-frequency components for said first control unit.

6. The method according to claim 5, further comprising using a band-pass filter in the 10–100 Hz range for obtaining the medium frequency components for said second control unit.

7. The method according to claim 4, further comprising using a band-pass filter in the 10-100 Hz range for obtaining the medium frequency components for said second control unit.

8. The method according to claim 4, said drafting unit comprising a final control device for controlling said drive assembly, said method further comprising the steps of:

(a) comparing said upstream measurement output signal to a preset value;

(b)(1) transmitting said upstream measurement output signal directly to said final control device in response to said upstream measurement output signal being determined, in said step of comparing, to be greater than said preset value, or (b)(2) multiplying said upstream measurement output signal by a control amplification factor to obtain a multiplied signal and transmitting said multiplied signal to said final control device in response to said upstream measurement output signal being determined, in said step of comparing, to be less than said preset value and;

(c) switching off optimization of the control amplification and optimization of delay time subsequent to said step of creating said upstream measurement output signal, in response to said upstream measurement output signal being determined, in said step of comparing, to be greater than said preset value, and switching on optimization of the control amplification and optimization of said delay time in response to said upstream measurement output signal being determined, in said step of comparing, to be less than said preset value.

9. The method according to claim 8, further comprising the steps of switching off optimization of said control amplification and said delay time upon said upstream measurement output signal exceeding said preset value and switching on optimization of said control amplification and said delay time upon said upstream measurement output signal falling below said preset value.

10. The method according to claim 4, wherein said upstream measuring element is a measuring capacitor, wherein said step of producing an upstream measurement output signal comprises measuring a change in dielectric caused passage of said sliver by said measuring capacitor.

11. The method according to claim 10, further comprising the step of dividing said upstream measurement output signal into a real part and an imaginary part and inputting said upstream measurement output signal into an identification field control unit and to a central computer.

12. The method according to claim 1, further comprising the step of inputting a draft-compensated signal to said central computer, wherein said upstream sliver cross-sectional signal and said draft-compensated signal are inputted in said central computer after being compensated for a time delay between measurement of said characteristic cross-section of said sliver in said upstream zone and said downstream zone.

13. The method according to claim 1, further comprising the step of compensating for said time delay in said central computer.

14. A method of controlling a drive assembly of a drafting unit including at least one auxiliary-controlled drive assembly by means of at least open control loop and at least one closed loop, including the measurement of at least one characteristic of a sliver being moved in an upstream-to-downstream direction through the drafting unit, said method comprising the steps of:

measuring said sliver characteristic in an upstream zone and producing an upstream measurement output signal for said open control loop and said closed control loop;

measuring said sliver characteristic in a downstream zone and producing a downstream measurement output signal for said open control loop and said closed control loop;

adjusting a control parameter of at least on control unit as a function of at least said downstream measurement output control signal; and adjusting a set value of said at least one auxiliary-controlled drive assembly as a function of the value of a variable manipulated by said method.

15. A method of controlling a final control device of a sliver drafting unit comprising an upstream measuring element at an upstream zone of the drafting unit and a downstream measuring element at a downstream zone of the drafting unit, said upstream measuring element and said downstream measuring unit outputting measured signals for a closed control loop and an open control loop, said method comprising the steps of:

(a) creating an upstream sliver cross-sectional signal representing a cross-section of said sliver by use of said upstream measuring element;

(b) comparing said upstream sliver cross-sectional signal to a preset value;

(c)(1) transmitting said upstream sliver cross-sectional signal directly to said final control device in response to said upstream sliver cross-sectional signal being determined, in said step of comparing, to be greater than said preset value, or (c)(2) multiplying said upstream sliver cross-sectional signal by a control amplification factor to obtain a multiplied signal and transmitting said multiplied signal to said final control device in response to said upstream sliver cross-sectional signal being determined, in said step of comparing, to be less than said preset value;

(d) switching off optimization of the control amplification and optimization of delay time subsequent to said step of creating said upstream sliver cross-sectional signal, in response to said upstream sliver cross-sectional signal being determined, in said step of comparing, to be greater than said preset value, and switching on optimization of the control amplification and optimization of said delay time in response to said upstream sliver cross-sectional signal being determined, in said step of comparing, to be less than said preset value; and (e) adding the signal determined in step (c), representing short-term deviations of said sliver and a signal representing long-term deviations of said sliver for adjusting the value of a manipulated variable for controlling said final control device.

16. The method according to claim 15, wherein said upstream measuring element is a measuring capacitor, wherein said step of creating an upstream sliver cross-sectional signal representing the cross-section of said sliver comprises measuring a change in dielectric caused passage of said sliver by said measuring capacitor.

17. The method according to claim 16, further comprising the step of dividing said upstream sliver cross-sectional signal into a real part and an imaginary part and inputting said upstream sliver cross-sectional signal into an identification field control unit and to a central computer.

18. The method according to claim 17, wherein said upstream sliver cross-sectional signal and said draft-compensated signal are inputted in said central computer after being compensated for a time delay between measurement of said characteristic of said sliver in said upstream zone and said downstream zone.

19. The method according to claim 18, further comprising the step of compensating for said time delay in said central computer.

20. The method according to claim 19, wherein said drafting unit includes at least one auxiliary-controlled drive assembly, said method further comprising the step of adjusting a set value of said at least one auxiliary-controlled drive assembly as a function of the value of a variable manipulated by said method.

21. The method according to claim 15, said drafting unit forming part of a drawframe or a combing machine, said method controlling said drawframe or said combing machine.

22. A drafting apparatus comprising:

at least one drive assembly for moving a sliver in an upstream-to-downstream direction;

means for controlling said at least one drive assembly, said means for controlling including at least one control unit for determining a control parameter;

means for measuring said sliver characteristic in an upstream zone and for producing an upstream measurement output signal as a function of said sliver characteristic;

means for measuring said sliver characteristic in a downstream zone;

mans for adjusting said control parameter of said at least one control unit as a function of at least said downstream measurement output control signal;

said at least one control unit comprises an identification field unit for establishing an identification field; and said means for adjusting the control parameter of the at least one control unit comprises means for adjusting said identification field as.a function of at least one downstream output measurement control signal.

23. The apparatus according to claim 22, further comprising:

means for converting said upstream measurement output signal into an upstream sliver cross-section signal as a function of said identification field, and representing short-term irregularities of the sliver at said upstream zone;

means for creating a draft compensation signal by draft compensation of said upstream sliver cross-section signal;

means for determining, in a central computer, the effective dependence of said draft compensation signal on said upstream measurement output signal, as a function of said upstream sliver cross-section signal, said downstream measurement output signal, and said upstream measurement output signal; and means for adjusting said identification field in response to determination of said effective dependence.

24. The apparatus according to claim 23, further comprising means for inputting at least one additional input variable to said central computer and wherein said means for adjusting said identification field determines said identification field additionally as a function of said at least one additional input variable.

25. The apparatus according to claim 22, wherein said at least one control unit comprises:

a first control unit for minimalizing high-frequency components of said downstream measurement output signal for determining a first time delay subsequent to said step of measuring said sliver characteristic in an upstream zone; and a second control unit for minimalizing medium frequency components of said downstream measurement output signal for determining an amplification factor.

26. The apparatus according to claim 25, further comprising a high-pass filter in the 100–300 Hz range in connection with said first control unit for obtaining said high-frequency components.

27. The apparatus according to claim 26, further comprising a band-pass filter in the 10–100 Hz range in connection with said second control unit for obtaining medium the frequency components.

28. The apparatus according to claim 25, further comprising a band-pass filter in the 10–100 Hz range in connection with said second control unit for obtaining medium the frequency components.

29. The apparatus according to claim 25, said drafting unit further comprising a final control device for controlling said drive assembly, said apparatus further comprising:

(a) means for comparing said upstream measurement output signal to a preset value;

(b) means for selectively (1) transmitting said upstream measurement output signal directly to said final control device in response to said upstream measurement output signal being determined, in response to said means for comparing, to be greater than said preset value, or (2) multiplying said upstream measurement output signal by a control amplification factor to obtain a multiplied signal and transmitting said multiplied signal to said final control device in response to said upstream measurement output signal being determined, in response to said means for comparing, to be less than said preset value; and (c) means for switching off optimization of the control amplification and optimization of delay time subsequent to measurement of said sliver characteristic in an upstream zone, in response to said upstream measurement output signal being determined, in said means for comparing, to be greater than said preset value, and switching off optimization of the control amplification and optimization of said delay time in response to said upstream measurement output signal being determined, in response to said means for comparing, to be less than said preset value.

30. The apparatus according to claim 29, further comprising means for switching off optimization of said control amplification and said delay time upon said upstream measurement output signal exceeding said preset value and for switching on optimization of said control amplification and said delay time upon said upstream measurement output signal falling below said preset value.

31. The apparatus according to claim 25, wherein said upstream measuring element is a measuring capacitor for measuring a change in dielectric caused passage of said sliver by said measuring capacitor.

32. The apparatus according to claim 31, further comprising means for dividing said upstream measurement output signal into a real part and an imaginary part and for inputting said upstream measurement output signal into an identification field control unit and to a central computer.

33. The apparatus according to claim 22, further comprising means for inputting a draft-compensated signal to said central computer, wherein said upstream sliver cross-sectional signal and said draft-compensated signal are inputted in said central computer after being compensated for a time delay between measurement of said characteristic cross-section of said sliver in said upstream zone and said downstream zone.

34. The apparatus according to claim 22, further comprising means for compensating for said time, delay in said central computer.

35. The apparatus according to claim 22, wherein said drafting unit includes at least one auxiliary-controlled drive assembly, said apparatus further comprising means for adjusting a set value of said at least one auxiliary-controlled drive assembly as a function of the value of a variable manipulated by said method.

36. An apparatus for controlling a final control device of a sliver drafting unit comprising:

an upstream measuring element at an upstream zone of the drafting unit;

a downstream measuring element at a downstream zone of the drafting unit;

means for creating an upstream sliver cross-sectional signal representing a cross-section of said sliver by use of said upstream measuring element;

means for comparing said upstream sliver cross-sectional signal to a preset value;

transmitting means for selectively (1) transmitting said upstream sliver cross-sectional signal directly to said final control device in response to said upstream sliver cross-sectional signal being determined, in response to said means for comparing, to be greater than said preset value, or (2) multiplying said upstream sliver cross-sectional signal by a control amplification factor to obtain a multiplied signal and thereafter transmitting said multiplied signal to said final control device in response to said upstream sliver cross-sectional signal being determined, in response to said means for comparing, to be less than said preset value;

means for switching off optimization of the control amplification and optimization of delay time subsequent to measurement of said upstream sliver cross-sectional signal, in response to said upstream sliver cross-sectional signal being determined, in response to said means for comparing, to be greater than said preset value, and for switching on optimization of the control amplification and optimization of said delay time in response to said upstream sliver cross-sectional signal being determined, in response to said means for comparing, to be less than said preset value;

means for adding the signal determined by said transmitting means, representing short-term deviations of said sliver and a signal representing long-term deviations of said sliver for adjusting the value of a manipulated variable for controlling said final control device.

37. The apparatus according to claim 36, wherein said upstream measuring element is a measuring capacitor for measuring a change in dielectric caused passage of said sliver by said measuring capacitor.

38. The apparatus according to claim 37, further comprising a central computer, wherein said at least one control unit comprises an identification field control unit, and wherein said apparatus further comprises means for dividing said upstream sliver cross-sectional signal into a real part and an imaginary part and for inputting said upstream sliver cross-sectional signal into an identification field control unit and to said central computer.

39. The apparatus according to claim 38, wherein said upstream sliver cross-sectional signal and said draft-compensated signal are connected to be inputted in said central computer after being compensated for a time delay between measurement of said characteristic of said sliver in said upstream zone and said downstream zone.

40. The apparatus according to claim 39, further comprising means for compensating for said time delay in said central computer.

41. The apparatus according to claim 40, wherein said drafting unit includes at least one auxiliary-controlled drive assembly, said apparatus further comprising means for adjusting a set value of said at least one auxiliary-controlled drive assembly as a function of the value of a variable manipulated by said apparatus.

* * * * *